US006368462B1

(12) United States Patent
Lumiala et al.

(10) Patent No.: US 6,368,462 B1
(45) Date of Patent: Apr. 9, 2002

(54) HEADBOX FOR A PAPER OR BOARD MAKING MACHINE

(75) Inventors: Juhana Lumiala; Antti Poikolainen, both of Jyväskylä (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/579,220

(22) Filed: May 26, 2000

(30) Foreign Application Priority Data

May 27, 1999 (FI) ..... 991199

(51) Int. Cl.[7] ..... D21F 1/08

(52) U.S. Cl. ..... 162/258; 162/259; 162/336; 162/343

(58) Field of Search ..... 162/202, 216, 162/258, 259, 336, 343

(56) References Cited

U.S. PATENT DOCUMENTS

| | | | | |
|---|---|---|---|---|
| 5,510,005 A | * | 4/1996 | Gingerich | 162/343 |
| 5,549,792 A | * | 8/1996 | Begemann et al. | 162/336 |
| 5,707,495 A | * | 1/1998 | Heinzmann et al. | 162/258 |
| 5,853,545 A | * | 12/1998 | Haraldsson et al. | 162/258 |
| 6,136,152 A | * | 10/2000 | Begemann | 162/336 |

* cited by examiner

*Primary Examiner*—Karen M. Hastings
(74) *Attorney, Agent, or Firm*—Steinberg & Raskin, P.C.

(57) ABSTRACT

The invention relates to a headbox (10) for a paper/boardmaking machine. The headbox (10) including a stock flow header (11) and, following the stock flow header, a piping system such as an inlet pipe manifold, and/or a turbulence generator (14) and a tapered slice (15), wherefrom the stock is passed onto the forming wire ($H_1$). The construction of said headbox further includes a flow header (J) for a dilution liquid the flow header having connected thereto an inlet channel ($S_1$), a return pipe ($S_2$) and outlet channels ($D_1$, $D_2$, $D_3$, . . . ) that are distributed over the full length of said flow channel for passing the dilution water to control valves ($V_1$, $V_2$, . . . ) and, therefrom, further to different points along the cross-machine width of the headbox so as to mix with the stock delivered from the stock flow header (11) in order to control the consistency of the stock to a desired value, thus accomplishing the control of the web basis weight profile in cross-machine direction over the headbox. The dilution water flow header (J) is structured to accomplish mixing of the dilution water flow ($L_1$) so as to make the consistency of the dilution water flow ($L_1$) homogeneous both along the entire length of the flow header (J) and in cross sections of the flow taken in planes perpendicular to the longitudinal axis of the flow header.

10 Claims, 9 Drawing Sheets

HEADBOX FOR A PAPER OR BOARD MAKING MACHINE

FIELD OF THE INVENTION

The present invention relates to a headbox for a paper or board making machine.

BACKGROUND OF THE INVENTION

The prior art discloses various headbox constructions in which the board or paper stock is pumped into a flow header that tapers toward the inlet end of the headbox and is then passed from the flow header into the inlet pipe manifold and, therefrom, onwards via a mixing chamber into the pipes of a turbulence generator and finally into the tapered slice. From the slice, the stock is passed onto the forming wire.

In headboxes of the type described above dilution water is passed form a dilution water flow header into dilution water channels and further via control valves to different points distributed over the cross-machine width of the headbox so as to control the basis weight profile of the formed web over the entire web width.

The dilution water is preferably taken from the drainage white water which passed from the wire section via the closed circulation system of the paper/boardmaking machine and thus has a low fiber and solids content. It has been found that the consistency of the dilution white water changes in the dilution water flow header so that the consistency is higher at the inlet side than at the bypass circuit side. This phenomena results in errors in controlling the basis weight profile by the weight basis control system because the same settings of the dilution water valve give different basis weight control responses at the inlet and outlet sides.

The cause of the above-mentioned error occurs because in a conventional dilution flow header arrangement the flow rate of dilution water circulation through the header is measured from only one side of the header. Thus, because the consistency of the dilution water varies along the length flow header, accurate control of basis weight profile cannot be attained.

OBJECTS AND SUMMARY OF THE INVENTION

The present application teaches a flow header construction in which the outlet flow of dilution water from the flow header has a constant consistency over the entire cross-machine length of the header. Toward this end, the dilution water flow header according to the present invention is provided with such a construction so that it is capable of disturbing the flow of the dilution water into the flow header and uniformly mixing the same. In order to reach this goal, one embodiment of the present invention uses a restriction or the like in front of the flow header to adjust the flow pattern of the dilution liquid to thereby insure that the consistency of the dilution liquid is consistent.

In another embodiment of the invention the inlet channel to the flow header is provided with area of increased diameter relative the remainder of the inlet channel. The are of increased diameter causes a pressure loss in the dilution liquid flow and equalizes the overall flow pattern, whereby the flow can be made to pass from end to end of the dilution water flow header with a substantially constant consistency over the entire cross section of the header. As a result, the header can keep the consistency of the dilution water flowing into the flow chamber outlet channels substantially equal in all running situations.

According to another aspect of the invention, the dilution water flow header is constructed so that the flow in the header is brought into a vorticose movement. The vorticose movement mixes the flow so that a zone of higher consistency does not develop at the rear wall of the flow header. The vorticose movement is achieved by passing the dilution water from the flow header into the dilution water outlet channels in a tangential fashion. By virtue of the vorticose flow pattern of the dilution water in the flow header, there is no risk of having a low-consistency zone formed at the rear wall of the flow header.

The present invention is further characterized by the use of "flow mixers" located at the inlet side of the header for equalizing the cross-sectional consistency profile and by utilizing a vorticose flow pattern for preventing the consistency profile from redeveloping its previous unequalized pattern.

The headbox construction according to the invention is further characterized in that the dilution water flow header includes integrated therein means for equalizing the flow pattern of the dilution water, whereby the dilution water flow has a substantially equal consistency over the entire cross-machine length of the flow header and in cross sections taken in planes perpendicular to the longitudinal axis of the flow header, thus equalizing the quality of dilution water in all the flow header outlet channels.

BRIEF DESCRIPTION OF THE DRAWINGS

In the following the invention will be described in more detail with reference to the following drawings in which.

DETAILED DESCRIPTION OF THE INVENTION

Figure 1A:
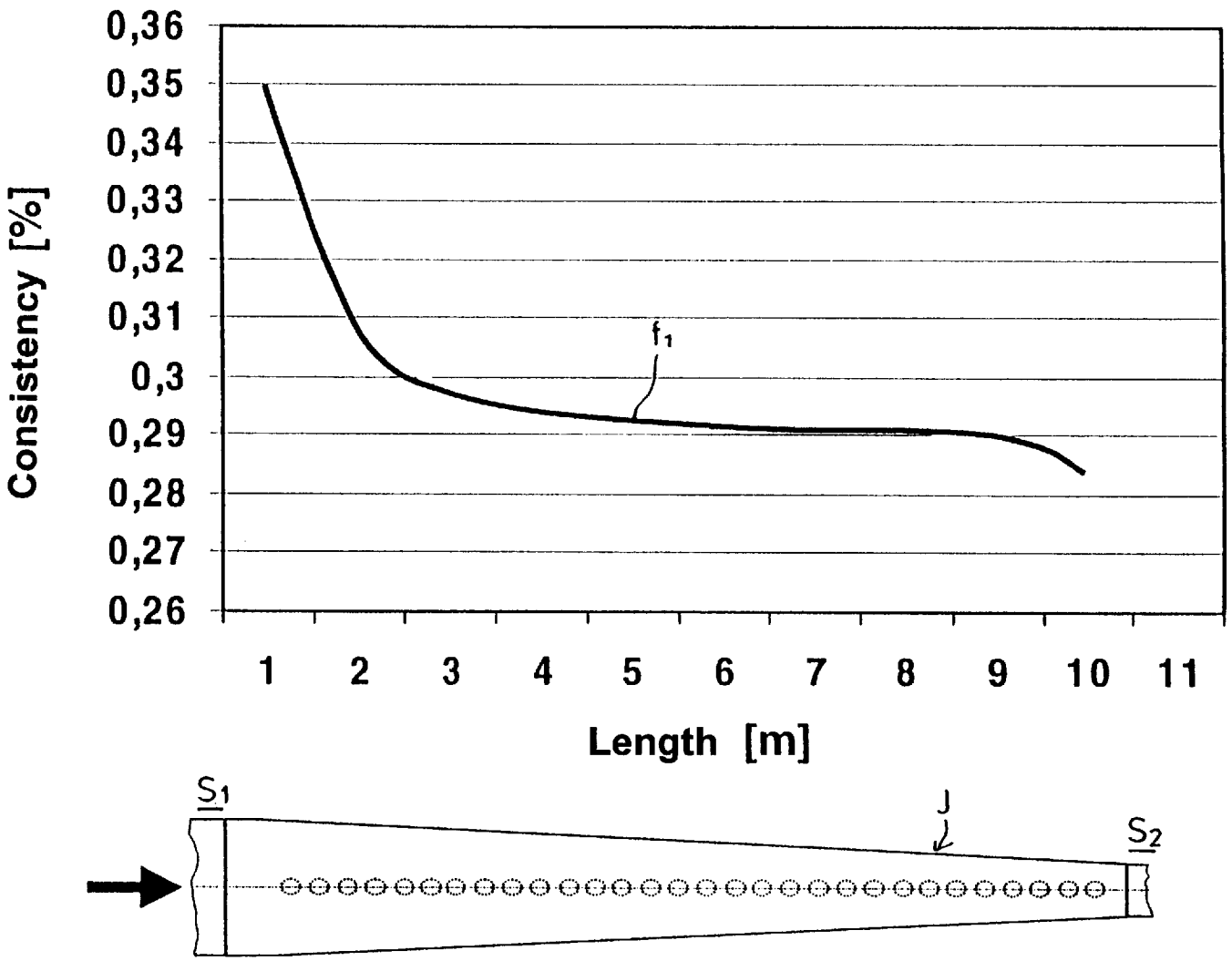
FIG. 1A is a graph depicting the difficulties associated with conventional dilution water flow headers, wherein the horizontal axis of the graph represents the length of the dilution water flow header and the consistency of the outlet dilution water flow is plotted on the vertical axis as a function of the length coordinate of the flow header, and wherein the curve $f_1$ represents the consistency behavior in a conventional dilution water flow header as obtained from a computational model assuming that the inlet flow into the flow header has a uniform cross-sectional flow profile of consistency.

The graph shown in FIG. 1A depicts the problematic behavior of a conventional dilution water flow header. The horizontal axis of the diagram represents the location coordinate of each dilution water outlet in the flow header, while on the vertical axis is plotted the consistency value in per cent at each respective dilution water outlet as function of the location coordinate of each outlet $D_1$, $D_2$, . . . along the length of the flow header. Hence, the curve $f_1$ represents the consistency profile of a dilution liquid in a conventional flow header. When the dilution liquid employed is white water of the wire section which is lean on fiber and solids, it is advantageous to feed all the dilution water channels $D_1$, $D_2$, . . . with white water having a homogeneous composition of a constant fiber and solids content. The plot of FIG. 1 represents a theoretical case obtained from a computational model assuming that the inlet flow into the inlet end $S_1$ of the flow header J has a uniform cross-sectional flow profile of consistency.

Figure 1B:
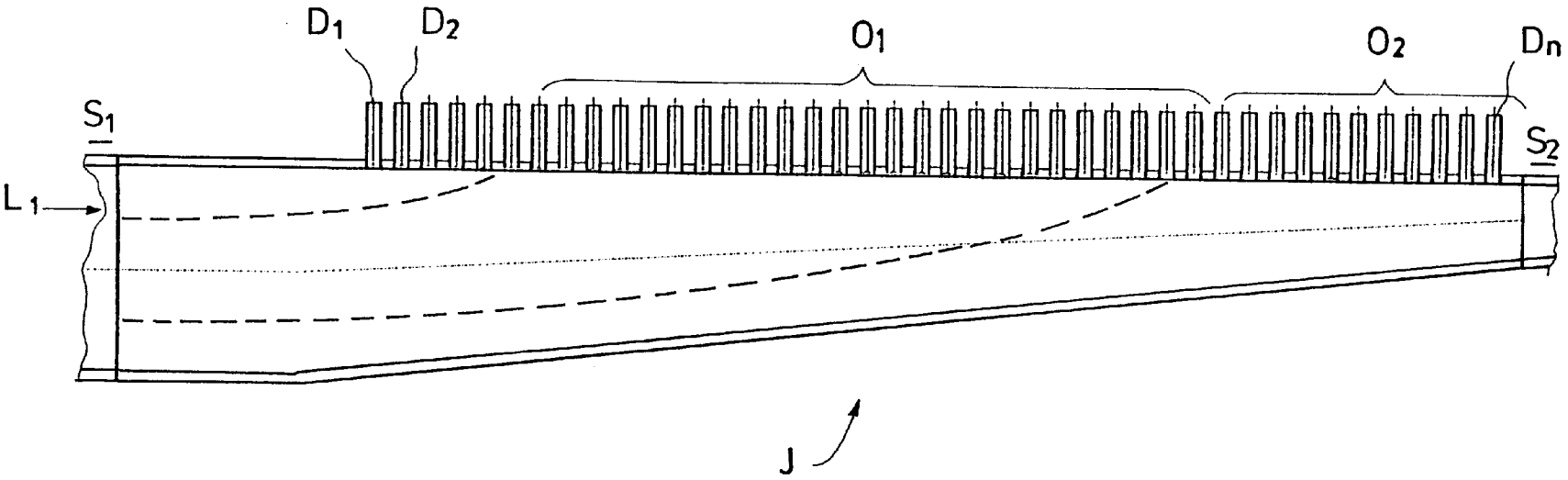
FIG. 1B is a diagram depicting the development of an unequal consistency distribution in a conventional dilution water flow header of a paper/boardmaking machine.

In FIG. 1B is illustrated the development of an unequal consistency distribution in a conventional dilution water flow header. At the inlet side, the average consistency is higher in zone $O_1$ than in zone $O_2$ at the outlet side in the bypass circulation. The consistency difference results from the fact that the solids of the flow are skimmed out in the flow header J only from one side of the flow passing through the header J. The lower-consistency portions of the flow are "consumed" in the first zones of the header J, whereupon the subsequent zones can only "consume" the higher-consistency portions of the flow from the core of the flow. As the rear zone of the dilution water flow header remains undischarged, a lower-consistency zone $O_2$ results.

Figure 1C:
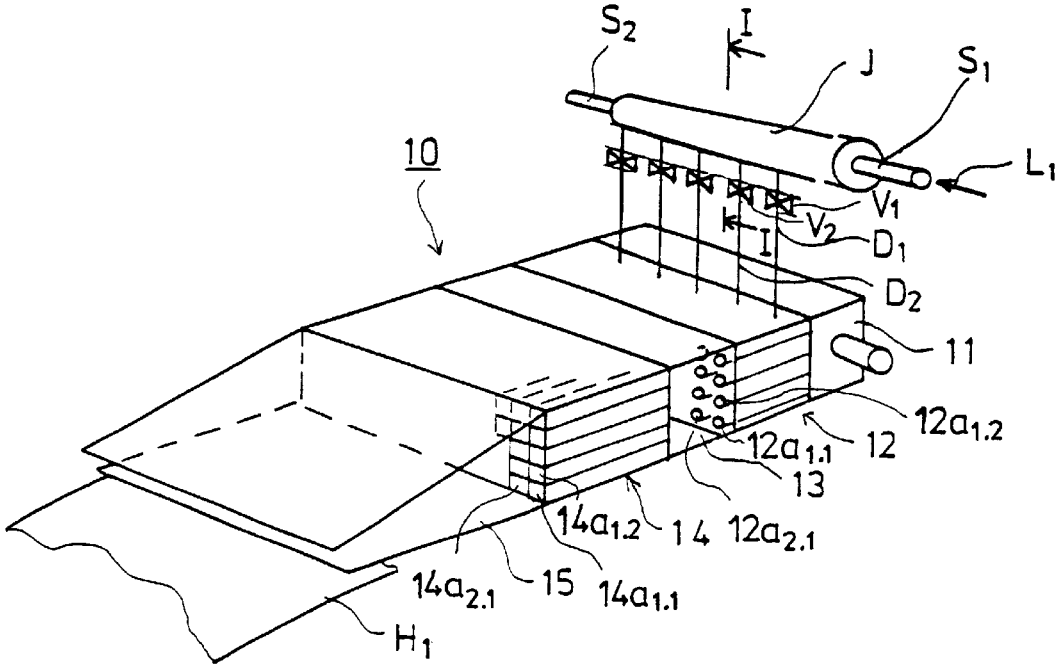
FIG. 1C is an axonometric view of a headbox according to the invention adapted to a paper/boardmaking machine.

The headbox 10 of a paper/boardmaking machine shown in FIG. 1C comprises a stock inlet pipe manifold 12 consisting of pipes 12$a_1$, 12$a_2$, . . . which are connected after a flow header 11. The inlet pipe manifold 12 is followed by a mixing chamber 13 and, after the mixing chamber 13, a turbulence generator 14 consisting of pipes 14$a_1$, 14$a_{1.2}$, . . . ; 14$a_{2.1}$, 14$a_{2.2}$, . . . The turbulence generator 14 is followed by a tapering slice 15, shortly a slice chamber, and from the slice 15 the stock is passed onto a forming wire $H_1$. From a dilution water flow header J, the dilution water is passed into channels $D_1$, $D_2$, $D_3$, . . . , and further via valves $V_1$, $V_2$, $V_3$, . . . located in the channels $D_1$, $D_2$, . . . to desired areas of the cross-machine width of the headbox in order to control the web basis weight profile to a desired value in the cross-machine direction as well as in the machine direction.

Figure 1D:
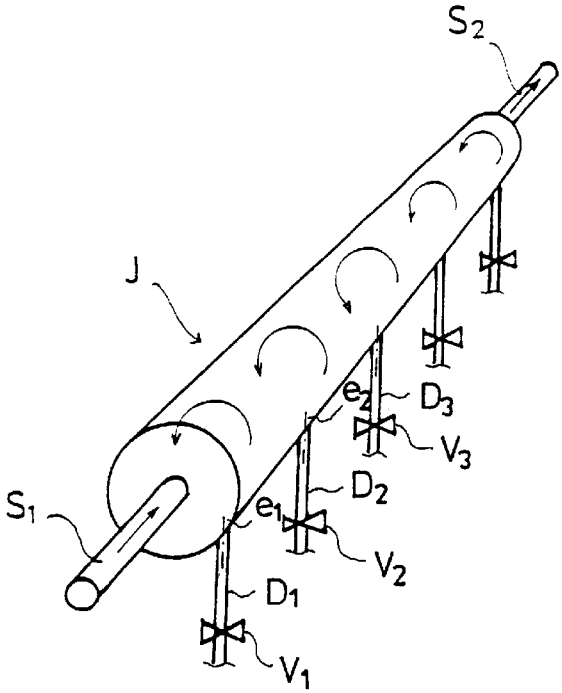
FIG. 1D is a detailed view of a dilution water flow header adapted to the paper/boardmaking machine shown in FIG. 1C.

FIG. 1D is shows a detailed view of the structure of a dilution water flow header J according to the invention. The flow header J is followed by dilution water outlet pipes $D_1$, $D_2$, $D_3$, . . . which pass the dilution water to control valves $V_1$, $V_2$, $V_3$, . . . According to the invention, the outlet pipes $D_1$, $D_2$, . . . are connected in a tangential fashion to the flow header J. In the illustrated embodiment, the flow header J has a circular cross section, whereby the center line $e_1$, $e_2$, . . . of each outlet channel $D_1$, $D_2$, . . . at the respective connection point is directed tangentially to the inner circumferential cross section of the flow header J. As is evident from the diagram, this arrangement forces the dilution water flow into a vorticose motion thus aiding the mixing of the superficial layers of the flow with that portion of the flow which passes more centrally in the flow header, whereby uniformity of the dilution water consistency is improved.

The dilution water inlet into the flow header J takes place via the inlet-side channel $S_1$, and a portion of the flow $L_1$ passed into the flow header is taken back into circulation via a bypass circuit channel $S_2$.

Figure 1E:
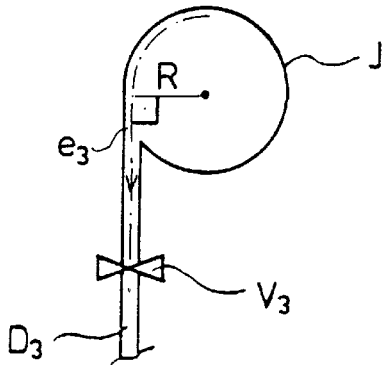
FIG. 1E is a sectional view taken along line I—I of FIG. 1C.

In FIG. 1E is shown a sectional view taken along line I—I of FIG. 1C. As can be seen from FIG. 1E, a channel $D_3$ is connected tangentially to the dilution water flow header J. The center axis $e_3$ of the channel $D_3$ at the connection point of the channel is aligned tangentially to the inner circumferential cross section of the flow header, whereby the center axis $e_3$ is normal to the radius R of the header cross section. In the illustrated embodiment, the outer wall of the channel $D_3$ joins tangentially to the outer wall of the flow header J. As a result, the dilution water flow into the outlet channel $D_3$ is taken from the peripheral region of the inner cross section of the flow header J.

Figure 2A:
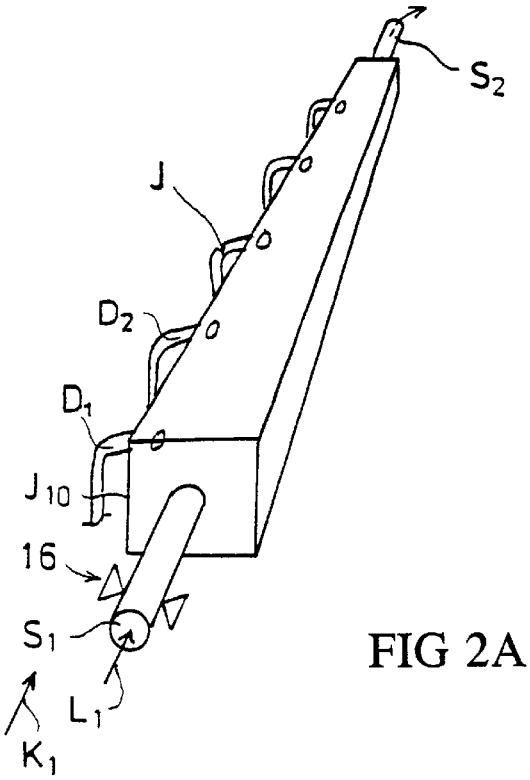
FIG. 2A is an axonometric view of an embodiment of a dilution water flow header according to the present invention, wherein the diagram depicts the use of a restriction element for equalizing the flow pattern.

As shown in FIG. 2A, a headbox 10 according to the invention has the inlet end channel $S_1$ of the flow header 11 provided with a restriction means 16, advantageously implemented as a restricted portion of the inlet end channel $S_1$. The restriction acts to mix the dilution water flow $L_1$ prior to the entry of the flow into the dilution water flow header J.

Figure 2B:
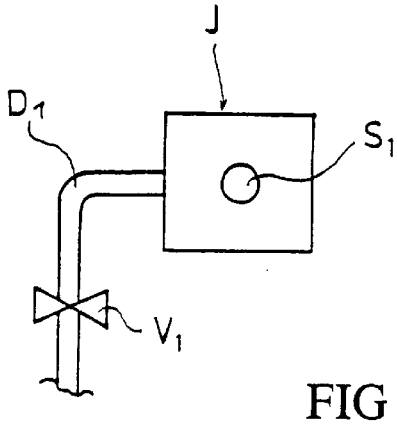
FIG. 2B is a view of the dilution water flow header of FIG. 2A taken from the direction of arrow $k_1$ in FIG. 2A.

In FIG. 2B, the dilution water flow header J is viewed from the direction of arrow $k_1$ drawn in FIG. 2A.

Figure 3A:
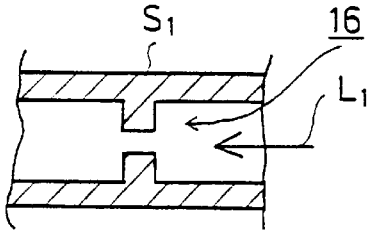
FIG. 3A is a view of a first preferred embodiment of a restriction element.

In FIG. 3A is shown a first preferred embodiment of a restriction element 16 in detailed view, wherein the restriction element formed into the inlet channel $S_1$ comprises a restricted portion of the inlet channel $S_1$. That is, the a portion of the inlet channel is provided with a reduced diameter relative to the remainder of the inlet channel.

Figure 3B:
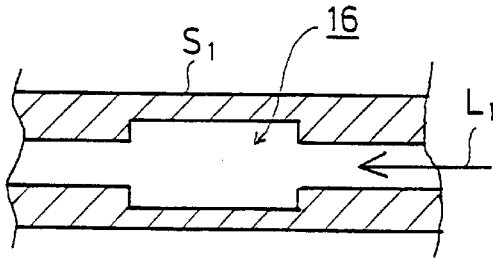
FIG. 3B is a view of a second preferred embodiment of a restriction element.

FIG. 3B is shows an alternative embodiment of the present invention, wherein the element 16 generating the pressure loss and, thence, the turbulence into the flow $L_1$ is implemented as an expanded portion of the channel $S_1$. As shown, the inlet channel is provided with a section 16 having a larger diameter relative to the remainder of the inlet channel which causes a pressure loss in the flow of the dilution liquid.

Figure 3C:
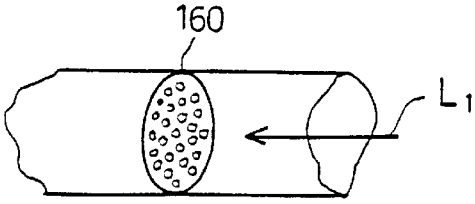
FIG. 3C is a view of a third preferred embodiment of a restriction element.

FIG. 3C shows another embodiment of the present invention in which the turbulence-generating restriction element comprises a perforated plate structure 160. As shown a perforated plate 160 is arranged within the inlet channel. The plate 160 is structured and arranged to fit within the inlet channel and is provided with a plurality of throughbores for permitting the flow of the dilution liquid through the plate.

Figure 4:
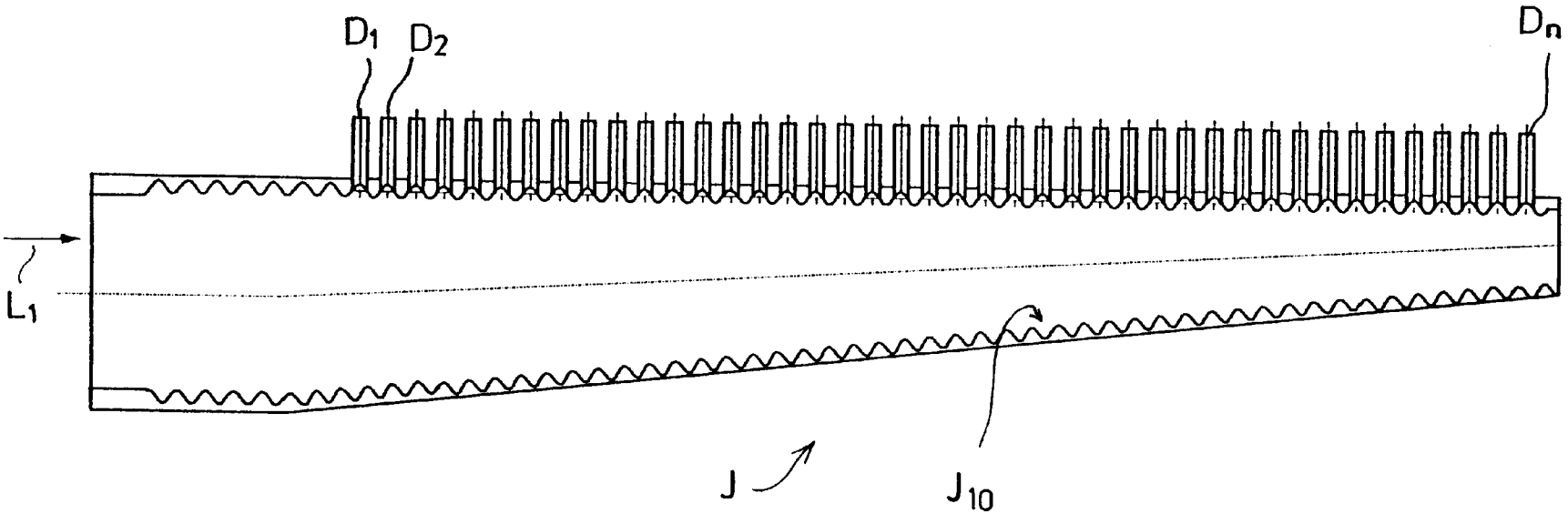
FIG. 4 is a view of an embodiment of the invention, wherein the flow is equalized in the dilution water flow header by virtue of providing the inner wall of the flow header with an undulated contour capable of disturbing the superficial flow along the flow header inner wall.

FIG. 4 shows an embodiment of the present invention in which the surface structure $J_{10}$ of the flow header J is provided with an irregular surface. As shown, the surface $J_{10}$ of the inner wall of the flow header is formed having an undulated contour that disturbs the laminar pattern of the superficial flow thus serving to make the consistency profile of the flow $L_1$ uniform over its entire cross-sectional area. As a result, the consistency in the dilution water flow $L_1$ is prevented from varying in the different regions over the cross-sectional area of the flow header inlet channel inasmuch such consistency differences would cause errors in the dilution water flow control.

Figure 5A:
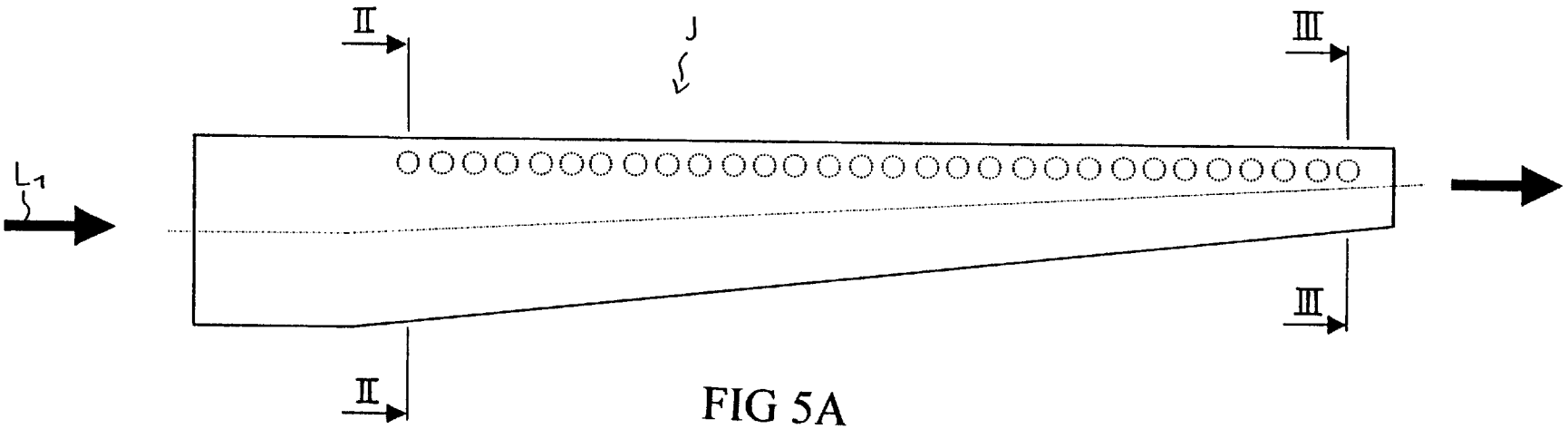
FIG. 5A is a side view of the flow header J.

In FIG. 5A is shown a side view of the flow header J.

Figure 5C:
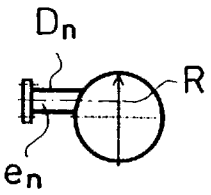
FIG. 5C is a sectional view taken along line III—III of FIG. 5A, illustrating an embodiment of the present invention in which the outlet channels are connected in a tangential fashion to the flow header J.
Figure 5B:
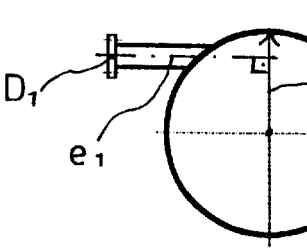
FIG. 5B is a sectional view taken along line II—II of FIG. 5A.

In FIG. 5B is shown a sectional view taken along line II—II of FIG. 5A, and in FIG. 5C is shown a sectional view taken along line III—III of FIG. 5A. In the embodiment illustrated in FIGS. 5A–5C, the outlet channels $D_1$, $D_2$, . . . are connected in a tangential fashion to the flow header J. For instance, the longitudinal axis $e_1$ of channel $D_1$ intersects the radius R of the circular cross section bore of the flow header J, in a plane perpendicular to the longitudinal axis of the flow header J, at a point from 0.3R to R along the radius R when the radius of the inner bore of the flow header J is denoted by symbol R. At said point of intersection, the longitudinal axis $e_1$ of the outlet channel $D_1$ is normal to the radius R of the flow header J. The other outlet channels $D_2$, $D_3$, . . . are respectively connected to the flow header J.

Figure 6A:
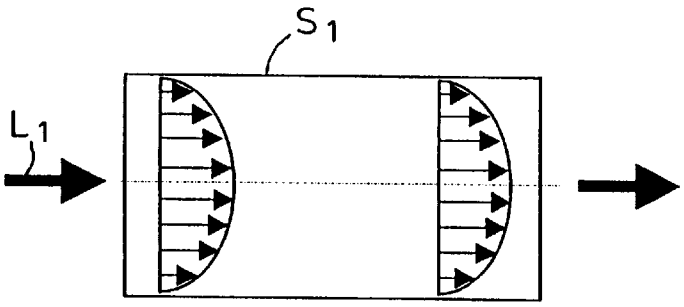
FIG. 6A shows the flow velocity profile in a channel $S_1$ not provided with a restriction element.
Figure 6B:
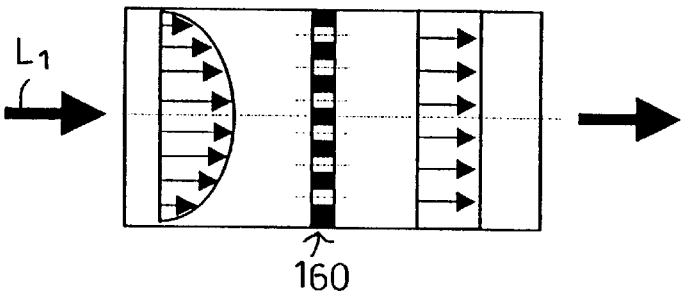
FIG. 6B shows the flow velocity profile in a channel $S_1$ in front of a restriction element 160 and thereafter when the restriction element is a perforated plate.
Figure 6C:
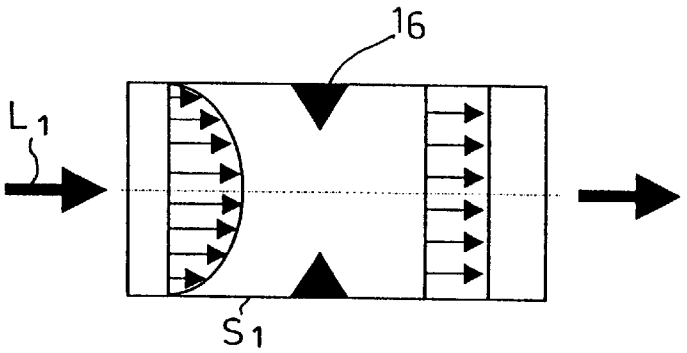
FIG. 6C shows the flow velocity profile in a channel $S_1$ in front of a restriction element 16 and thereafter when the restriction element is a constricted channel.

FIGS. 6A, 6B and 6C illustrate the flow velocity profile equalization and the resultant smoothing of the consistency profile achievable by virtue of the restriction means 16, 160. In FIG. 6A, the inlet channel $S_1$ has no separate restriction element. Hence, the flow velocity and consistency profiles become such as those shown in the diagram. FIG. 6B shows the flow velocity pattern when the inlet channel $S_1$ is provided with a perforated plate 160. The perforated plate 160 equalizes the flow velocity so that the flow velocity profile as well as the consistency profile are uniform and remain so after leaving the perforated plate 160. FIG. 6C represents a situation in which the restriction means 16 comprises a restricted portion of the inlet channel, i.e. an area of reduced diameter. Again the area of reduced diameter serves to equalize the flow profile.

Figure 7A:
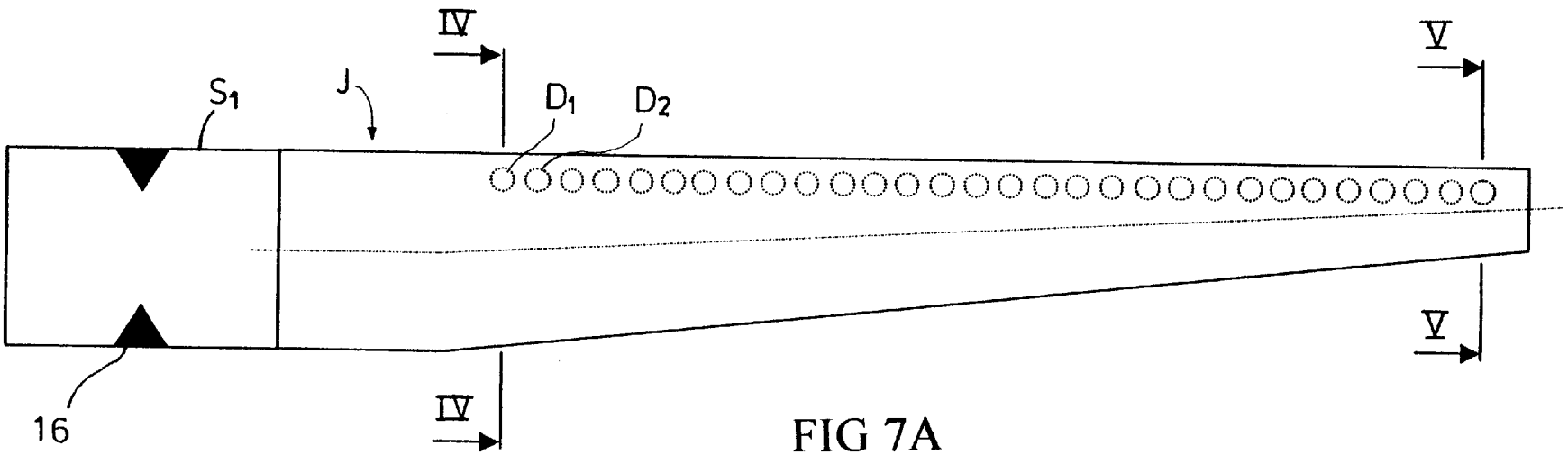
FIG. 7A is a side view of an embodiment of the present invention having an inlet channel $S_1$ to the flow header J provided with a flow restricting element 16 of the constricted channel type and further having a plurality of outlet channels ($D_1$, $D_2$,) connected to the flow header J in a tangential fashion.
Figure 7C:
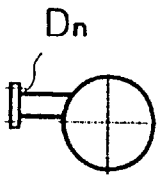
FIG. 7C is a sectional view taken along line V—V of FIG. 7A.
Figure 7B:
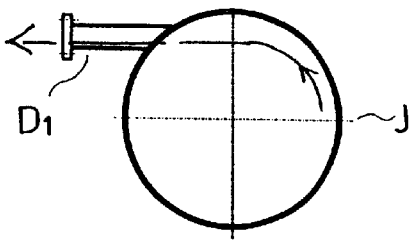
FIG. 7B is a sectional view taken along line IV—IV of FIG. 7A.

FIG. 7A depicts an embodiment of the invention in which the flow header J has a circular cross section and outlet channels $D_1$, $D_2$, $D_3$ are connected in a tangential fashion thereto. In addition, inlet channel $S_1$ is provided with a flow restriction means 16. FIG. 7B depicts a sectional view taken along line IV—IV of FIG. 7A and in FIG. 7C shows a sectional view taken along line V—V of FIG. 7A. The outlet channels $D_1$, $D_2$, . . . are aligned in tangential fashion and the restriction means 16 is implemented as a discrete narrow portion of the inlet channel.

Figure 8A:
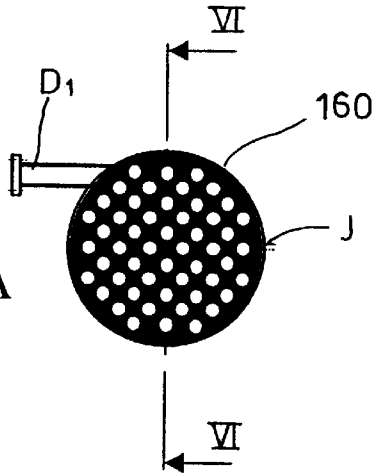
FIG. 8A is a view of a restriction element 16 mounted in the flow header J as seen from the inlet end direction of the flow header.
Figure 8B:
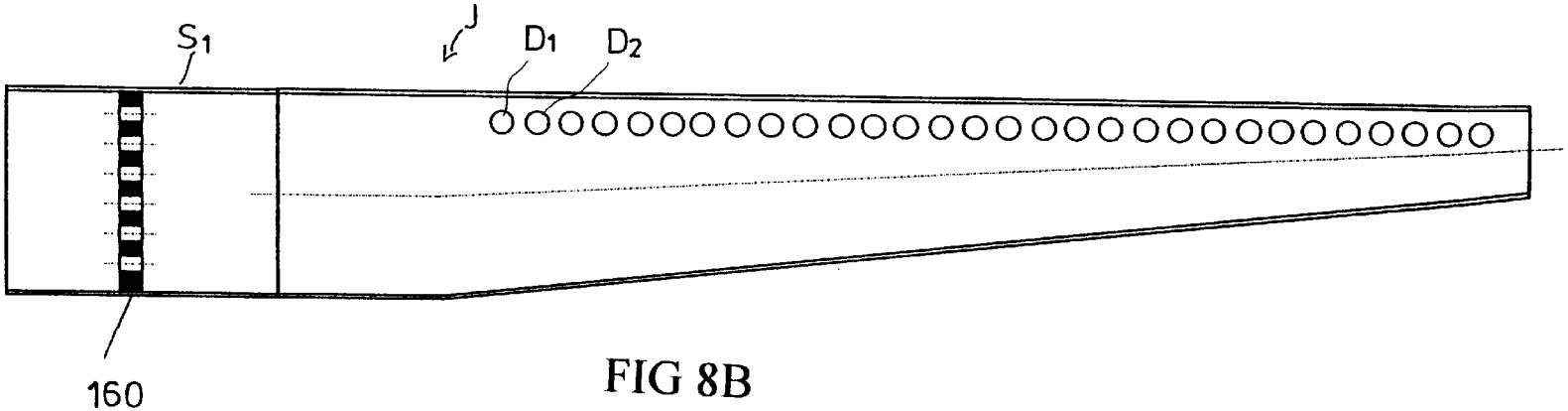
FIG. 8B is a sectional view taken along line VI—VI of FIG. 8A.

FIG. 8A illustrates a flow header J and a restriction element 16 mounted at the inlet of the flow header as seen from the inlet end direction of the dilution water flow header J. In FIG. 8B is shown a sectional view taken along line VI—VI of FIG. 8A. As is evident from the diagrams, the inlet channel $S_1$ of the flow header J has a perforated plate 160 separately mounted therein and the outlet channels $D_1$, $D_2$, . . . , that pass the dilution water flows out from the flow header J are also herein aligned in a tangential fashion.

The foregoing description of the invention has been presented for purposes of illustration and description. It is not intended to be exhaustive or to limit the invention to the precise form disclosed. Obvious modifications and variations are possible in light of the above teachings and are considered within the scope of the present invention.

What is claimed is:

1. A headbox (10) for a paper/boardmaking machine, the headbox comprising a stock flow header (11) and, following the stock flow header (11), a piping system and a tapered slice (15), wherefrom the stock is passed onto a forming wire ($H_1$), said headbox further including a flow header (J) for distributing a dilution liquid, said flow header having connected thereto an inlet channel ($S_1$), a return pipe ($S_2$) and outlet channels ($D_1$, $D_2$, $D_3$, . . . ) structured and arranged for passing the dilution water to control valves ($V_1$, $V_2$, . . . ) and, therefrom, further to different points along the cross-machine width of the headbox so as to mix the dilution water with the stock delivered from the stock flow header (11) in order to control the consistency of the stock to a desired value, thus accomplishing the control of the web basis weight profile in cross-machine direction over the headbox, wherein said dilution water flow header (J) includes integrated therein means (16, 160) serving to accomplish mixing of the dilution water flow ($L_1$) so as to make the consistency of the dilution water flow ($L_1$) maximally homogeneous both along the entire length of the flow header (J) and in cross sections of the flow taken in planes perpendicular to the longitudinal axis of the flow header, whereby also the outlet flows of the dilution water passed via the channels ($D_1$, $D_2$, . . . ) have a maximally equal consistency.

2. The headbox according to claim 1, wherein said means for equalizing the flow consistency comprises a restriction element (16) in the interior of the inlet channel ($S_1$) of the flow header (J), said element being implemented as a restricted or expanded portion of said inlet channel.

3. The headbox according to claim 1, wherein said means for equalizing the flow consistency comprises a perforated plate (160) arranged in the interior of the inlet channel ($S_1$) or in a close vicinity to the inlet end of the flow header (J) so as to precede said outlet channels ($D_1$, $D_2$, . . . ).

4. The headbox according to claim 1, wherein said means for equalizing the consistency of the dilution water flow comprises an uneven surface structure ($J_{10}$) of the interior of the flow header (J), said structure serving to disturb the flow of the dilution water to thereby mix said flow.

5. The headbox according to claim 1, wherein said means for equalizing the flow consistency in the flow header (J) comprises an arrangement having the dilution water outlet channels ($D_1$, $D_2$, . . . ) connected in a tangential fashion to said flow header (J) having a circular cross section, whereby the dilution water flow passed out from the flow header via said outlet channels ($D_1$, $D_2$, . . . ) generates a vorticose dilution water flow ($L_1$) in the interior of said flow header (J).

6. A headbox comprising:

a stock flow header for providing a stock flow;

a stock inlet pipe manifold arranged in communication with said stock flow header;

a mixing chamber arranged in communication with said stock inlet pipe manifold;

a turbulence generator arranged in communication with mixing chamber;

a tapering slice arranged in communication with said turbulence generator for transferring said stock flow to a forming wire;

a dilution water flow header for holding and delivering a dilution liquid to said headbox, said dilution flow header including an inlet channel for delivering a flow of dilution liquid into a body of said dilution water flow header and means integral with said dilution flow header for establishing a uniform consistency of said dilution liquid along an entire length of said flow header body.

7. A headbox according to claim 6, wherein said means for establishing a uniform consistency of said dilution liquid comprises a restriction element arranged within said inlet channel.

8. A headbox according to claim 6, wherein said means for establishing a uniform consistency of said dilution liquid comprises a perforated plate arranged within said inlet channel.

9. A headbox according to claim 6, wherein said means for establishing a uniform consistency of said dilution liquid comprises an irregular interior surface of said flow header body.

10. A headbox according to claim 6, wherein said means for establishing a uniform consistency of said dilution liquid comprises at least one outlet channel arranged in communication with said flow header body, said at least one outlet channel arranged in tangential relationship with said flow header body.

* * * * *